US006349652B1

(12) United States Patent
Hepner et al.

(10) Patent No.: US 6,349,652 B1
(45) Date of Patent: Feb. 26, 2002

(54) AEROBALLISTIC DIAGNOSTIC SYSTEM

(75) Inventors: David J. Hepner, Elkton; Michael S. L. Hollis; Peter C. Muller, both of Abingdon; Thomas E. Harkins, Joppa, all of MD (US); Gary Borgen, Camarillo, CA (US); William P. D'Amico, Havre de Grace, MD (US); Bradford S. Davis, Jarrettsville, MD (US); Lawrence W. Burke, Pylesville, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/770,780

(22) Filed: Jan. 29, 2001

(51) Int. Cl.[7] ..... F42B 10/00; F42C 17/00

(52) U.S. Cl. ..... 102/519; 244/3.2; 244/3.23; 898/6; 898/6.5

(58) Field of Search ..... 102/293, 518, 102/519; 244/3.2, 3.21, 3.23; 89/6, 6.5

(56) References Cited

U.S. PATENT DOCUMENTS

| | | | | | |
|---|---|---|---|---|---|
| 3,714,898 | A | * | 2/1973 | Ziemba | 89/6 |
| 5,647,558 | A | * | 7/1997 | Linick | 244/3.2 |
| 6,163,021 | A | * | 12/2000 | Mickelson | 274/3.2 |
| 6,189,430 | B1 | * | 2/2001 | Vornfett | 89/65 |
| 6,202,532 | B1 | * | 3/2001 | Kadushin | 89/6 |
| 6,216,595 | B1 | * | 4/2001 | Lamorlette et al. | 89/6.5 X |
| 6,283,407 | B1 | * | 9/2001 | Hackenesch | 244/3.21 |

* cited by examiner

*Primary Examiner*—Peter A. Nelson
(74) *Attorney, Agent, or Firm*—Paul S. Clohan

(57) ABSTRACT

A system which is packaged within a projectile fuze body and obtains data relative to the projectile during a launch. Sensors are provided which obtain in-bore data as well as in-flight data. The in-bore data is recorded at a fast rate during in-bore travel of the projectile and is read out, continuously, at a slower rate during in-flight travel. Both in-bore data and in-flight data are encoded and transmitted to a ground station for analysis.

17 Claims, 9 Drawing Sheets

AEROBALLISTIC DIAGNOSTIC SYSTEM

STATEMENT OF GOVERNMENT INTEREST

The invention described herein may be manufactured and used by or for the Government of the United States of America for government purposes without the payment of any royalties therefor.

BACKGROUND OF THE INVENTION

Accurate measurement of the aeroballistic flight characteristics of spinning bodies, with on-board sensors, significantly contributes to the research and development of experimental projectiles, and to the diagnosis of existing munitions systems.

Various systems exist for obtaining projectile data while the projectile is still traveling within the bore of a gun barrel. The in-bore techniques have not been able to provide good quality measurements for many reasons. These in-bore techniques have included: 1) Hardwiring of sensors on-board the projectile directly to recording equipment located outside of the gun tube. This technique suffered from wire breakage and loss of data. 2) Radio frequency transmission of the in-bore data out of the gun. This technique has loss of data due to the ionized gasses obscuring the RF signal. 3) Laser beam transmission of the in-bore data out of the gun tube. The major difficulty with this technique was the critical alignment requirements of the transmitter and its receiving station. In addition, blow-by gasses leaking around the projectile as it traveled up the gun tube usually obscured and attenuated the laser light beam and resulted in further loss of data. 4) On-board recorders that store the in-bore measurements. Recovery of the projectile is extremely difficult. Many artillery projectiles are fired in excess of 20 km and penetrate deep into the earth. Many proving grounds fire into areas off limits or into water making recovery impossible. 5) An on-board telemetry system that stores the in-bore measurement data and then transmits it after a delay. This type of system has only measured the in-bore data and the volume taken up by the system has required major modification to the projectile.

For a complete analysis, data during the projectile's flight outside the gun barrel is also required. Ground-based instrumentation systems can provide some of these measurements, but are generally used for only limited portions of a projectile flight for reasons of both expense and practicability in application. In another system, such as shown in U.S. Pat. No. 5,909,275, light sensors positioned around a fuze-like body of a projectile, to sense the sun, are used to provide parameters pertaining to the solar attitude and solar roll angle.

There is a need, however, for a system which is capable of obtaining aeroballistic data, starting from a projectile's initial in-bore launch and throughout its entire flight with no loss of data.

SUMMARY OF THE INVENTION

The diagnostic system of the present invention meets the objective of obtaining aeroballistic data starting from a projectile's initial in-bore launch from a gun and throughout its entire flight, with no loss of data.

The diagnostic system includes a container which can attach to the projectile, and has a fuze shaped body. The interior holds a plurality of sensor arrays, one of which obtains projectile data during in-bore travel of the projectile. Other ones of the sensor arrays obtain projectile data during in-flight travel of the projectile. Also positioned within the container is a recording means which, when activated, stores the in-bore data, at a first rate, and reads the data out, at a slower rate, while the projectile is in-flight. The in-bore data and the in-flight data are encoded and provided to a utilization means, such as a transmitter and associated antenna, also within the container, for transmission of both in-bore and in-flight data to a ground station, for processing of the data. In another embodiment the utilization means is comprised of a microprocessor and guidance control unit for governing flight direction of the projectile.

BRIEF DESCRIPTION OF THE DRAWINGS

The invention will be better understood, and further objects, features and advantages thereof will become more apparent from the following description of the preferred embodiment, taken in conjunction with the accompanying drawings, in which.

DETAILED DESCRIPTION OF THE PREFERRED EMBODIMENTS

Figure 1:
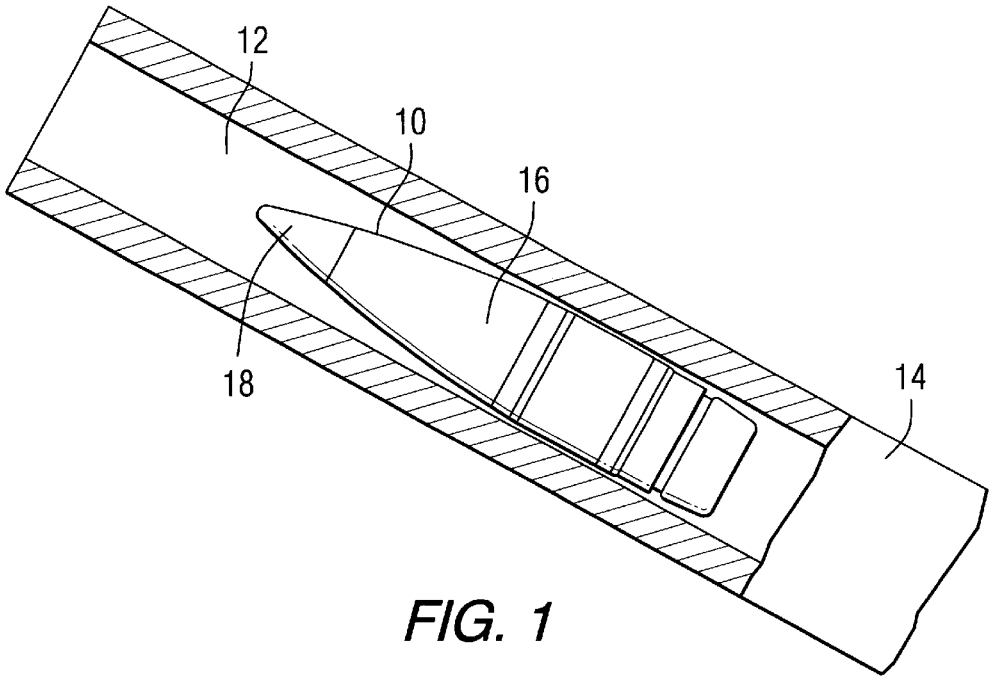
FIG. 1 is a side view, partially in section, of a projectile within a gun barrel.

In the drawings, which are not necessarily to scale, like or corresponding parts are denoted by like or corresponding reference numerals.

FIG. 1 illustrates a projectile, an artillery shell 10, traveling within the bore 12 of a projectile launcher, such as an artillery gun 14. The artillery shell 10 is comprised of a case body 16, filled with, for example, an explosive bursting charge, and includes a fuze 18 threaded into the front end of the case body for causing detonation of the charge as a result of impact with, or proximity to, a target.

In an embodiment of the present invention the conventional fuze 18 is replaced with a complete diagnostic system for obtaining not only information relative to the projectile's travel inside the bore 12, but in-flight data as well. Although an artillery shell 10 is illustrated, the invention is also applicable to other projectiles such as tank rounds, munitions, rockets, missiles, sub-munitions bullets and other weapon systems.

Figure 2:
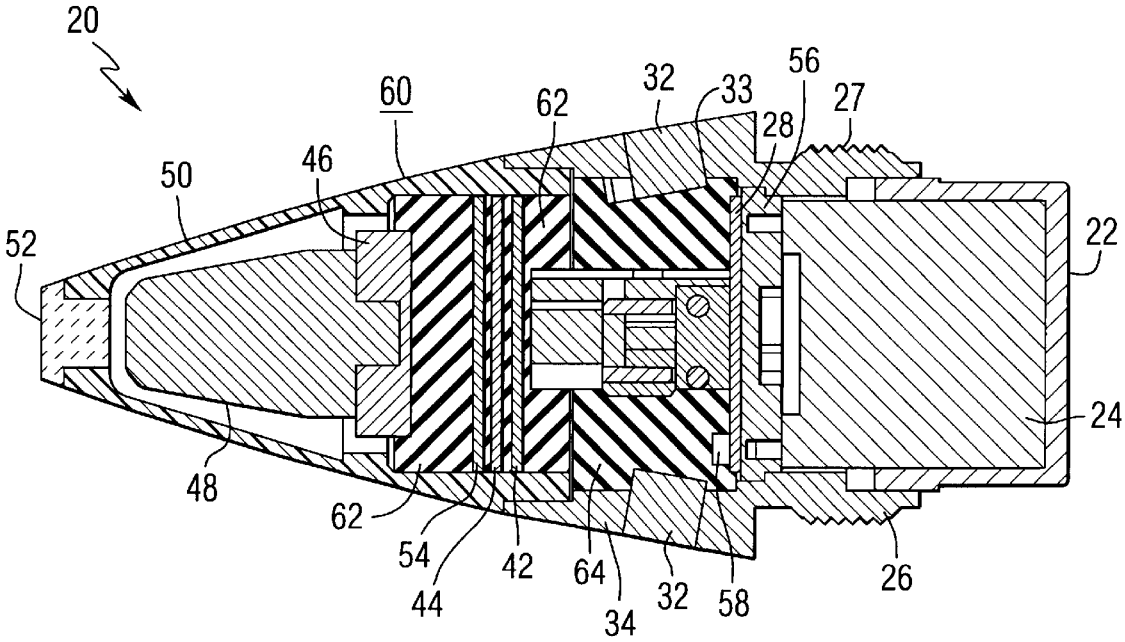
FIG. 2 is a side view, partially in section, of the diagnostic system of the present invention.
Figure 3:
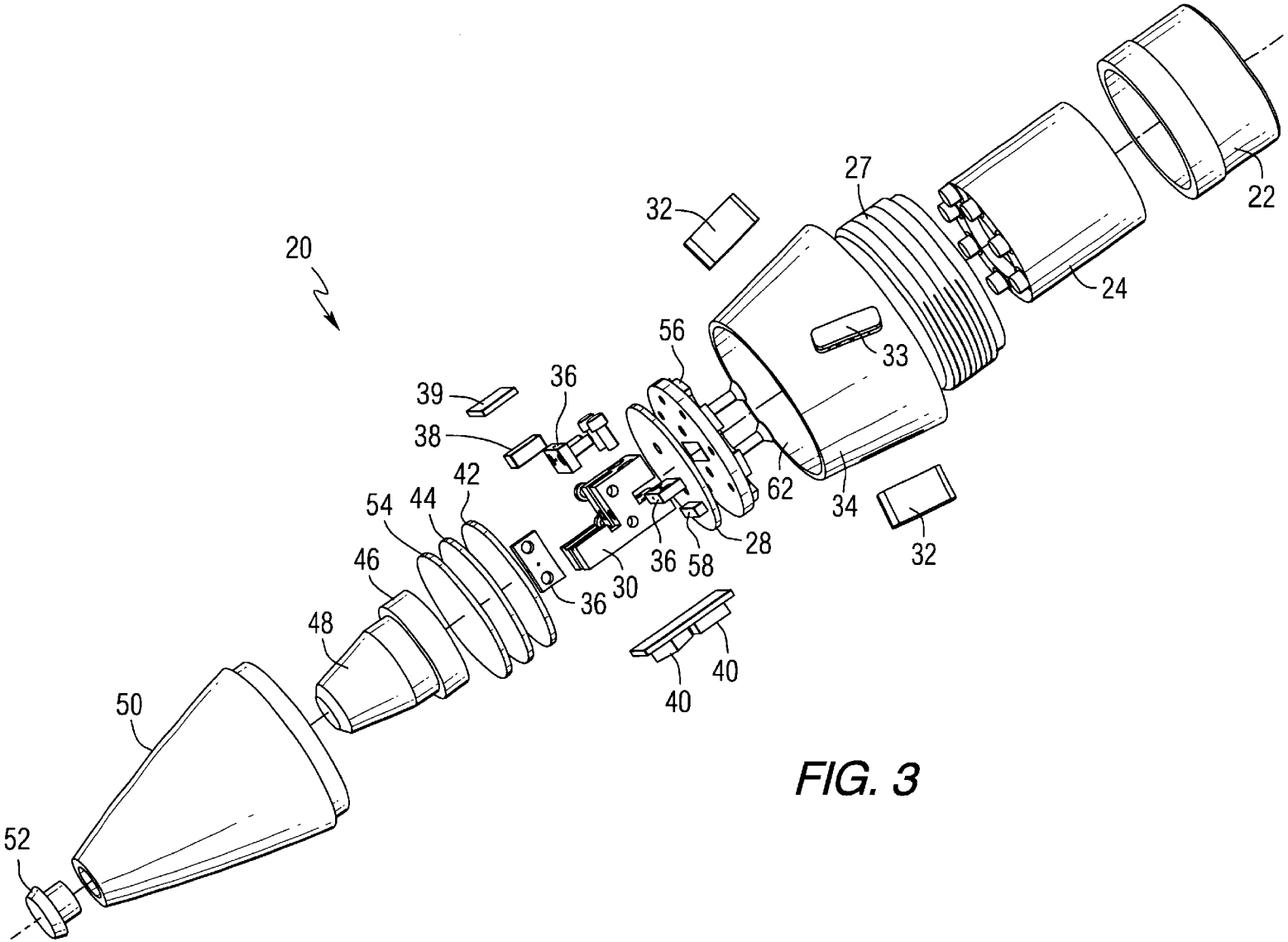
FIG. 3 is an exploded view of the diagnostic system.

FIG. 2 is a side view of a diagnostic system 20, partially in section, in accordance with an embodiment of the present invention, and FIG. 3 displays an exploded assembly schematic of the major components of the system used on gun tube launched artillery and other vehicles.

The diagnostic system 20 includes a battery cup 22, power supply 24, stem 26, having threads 27, sensor bus board 28, accelerometer bracket 30, optical sensors 32, which fit into respective windows 33 in faring 34, high-g accelerometers 36, low-g accelerometer 38 with its associated board 39, magnetometers 40, signal conditioning and power regulation circuit 42, data encoding in-bore delay recorder 44, transmitter 46, antenna 48, windshield 50, ceramic nose-tip 52, PCM (pulse code modulation) encoder 54, battery connector 56 and g-switch 58.

More particularly, the diagnostic system 20 includes a container 60, having an interior 62, into which the various components are packaged. The container 60 is a conventional fuze body, which may be threaded into a standard artillery shell, such as used by NATO forces, thus requiring no modification to the artillery projectile body itself.

High-g accelerometers 36, such as Model 7270, manufactured by Endevco, San Juan Capistrano, Calif., are rigidly mounted with accelerometer bracket 30 in the fuze body 60 to sense and measure the axial and radial acceleration environment that the projectile to which it is attached is subjected to, during launch. The low-g accelerometer 38, such as Model ADXL78, manufactured by Analog Devices, Norwood, Mass., senses and measures the axial acceleration. The magnetometers 40, such as Model HMC1002 manufactured by Honeywell, Plymouth, Minn., sense and measure the magnetic field. Optical sensors 32, such as described in the referenced U.S. Pat. No. 5,909,275, sense the solar light. A 5V power supply 24, such as the $LiMnO_2$ primary battery manufactured by Ultralife Battery, powers the system through the battery connector 56. Power regulation is provided and all channels are conditioned, if required, by the signal conditioning and power regulation circuit 42 prior to being recorded and transmitted.

The in-bore delay recorder 44 design is intended to capture the high-g accelerometer portion of aeroballistic data while the projectile is in the bore of the gun. Specifications for this design include a 150 kHz digitizing rate at 12-bit resolution for 20 ms and 15 kHz playback rate with an effective data bandwidth of 60 kHz. This duration can be increased to 40 ms at the cost of reducing the data bandwidth in half. The circuit accomplishes this task by digitally recording the data from high-g accelerometers 36 in memory when triggered by the g-switch 58, such as Model 8463-2 manufactured by Aerodyne Controls, Ronkonkoma, N.Y.

Once the data is stored, the memory is read and converted back to an analog signal for the purposes of working with any transmitter system. To accommodate the limited bandwidth of the transmitter 46, the data from high-g accelerometers is read at one tenth the rate at which it was stored. This data is then played back, during in-flight travel of the projectile, by the in-bore delay recorder 44 in a continuous "loop" to enhance the probability that the data will not be lost due to a possible interruption of the telemetry link.

The diagnostic system 20 is designed to endure the high acceleration environment experienced during the gun launch of a ballistic flight vehicle and is designed to be compact and lightweight. The diagnostic system 20 must be able to withstand the linear accelerations of gun launching. Maximum acceleration levels are 30,000 times the earth's gravity, with 150,000 rad/sec$^2$ of angular acceleration for artillery cannon launching. The system must also withstand the spin-rate of 300 Hz or higher associated with high-speed artillery projectile flight. Surviving these accelerations and forces depends on the choice of materials of which the diagnostic system 20 is composed, and its packaging. For instance, the system uses chip-level and surface-mounted electronic components that are encapsulated in a potting material 64 (FIG. 2) such as STYCAST 1090. The small size of the electronic components and the rigidity of the potting material 64 increase the survivability of the entire diagnostic system 20, during launch as well as in flight. In addition to surviving the high accelerations encountered, the system is also capable of surviving other stresses resulting from high rates of speed.

The diagnostic system 20 is intended to survive cannon launches with velocities in excess of Mach 3. Therefore, the windshield 50 is designed to withstand the extreme heat due to the aerodynamics, while maintaining the ability to appear transparent to radio-frequency transmission. The windshield 50 is made of a non-metallic material such as Nylon 6/6, and the nose-tip 52 is made of machineable ceramic. Nylon has high strength and tolerance to heat. The ceramic nose-tip 52 has extreme tolerance to heat, therefore, it is used on the very front of the fuze body 60 where the stagnation temperatures are extreme. The stem 26 and battery cup 22 are fabricated from aluminum, type 7075-T651, for optimal strength to weight ratio.

The invention is designed such that in can be assembled to any NATO compatible, or other artillery projectile. This requires that the stem 26 use specific threads 27 to interface to the projectiles, and to have a specific intrusion depth. The intrusion depth is the length of the fuze body 60 that can fit inside of an artillery projectile, and still maintain functionality.

Figure 4:
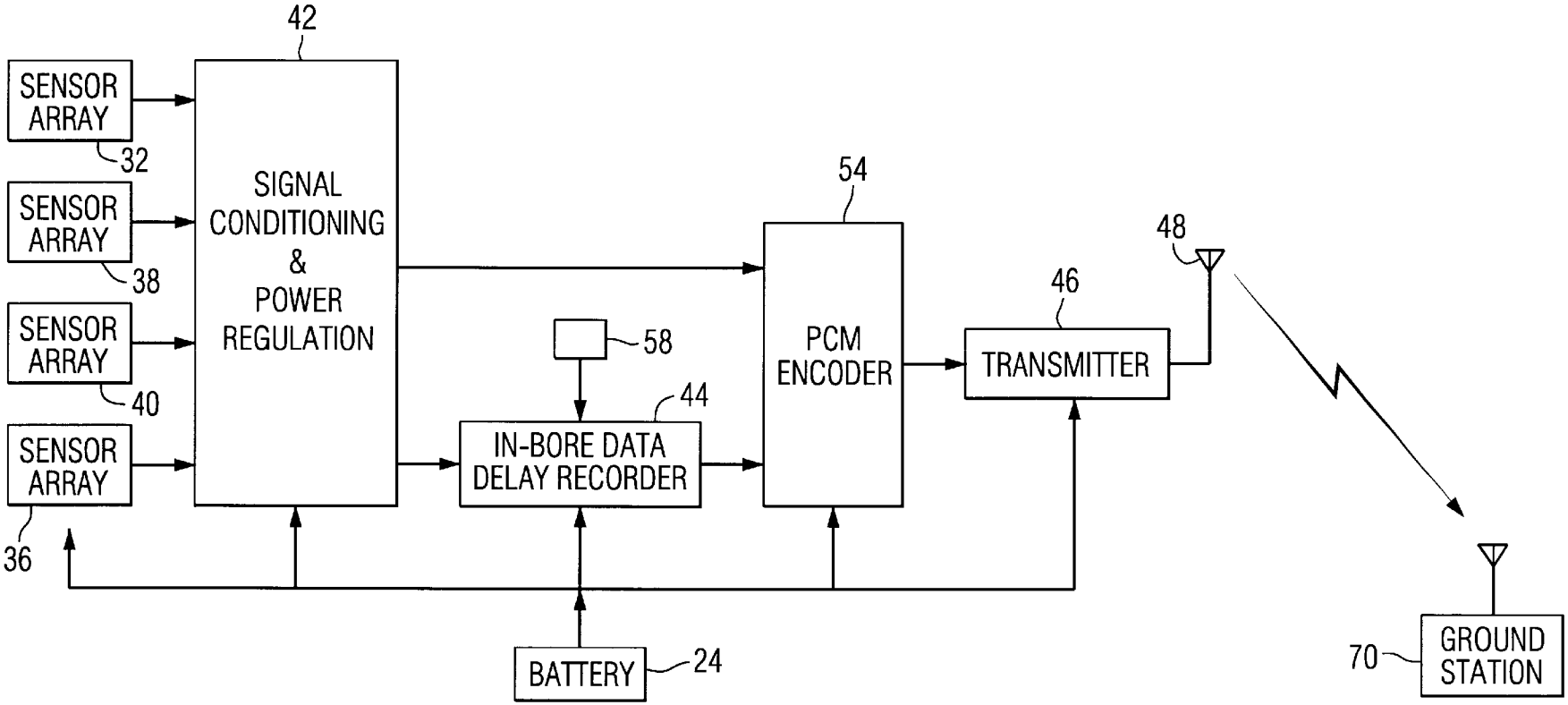
FIG. 4 is a block diagram of the diagnostic system of the present invention in a data transmission configuration.

A block diagram of the electronics portion of the diagnostic system 20 is illustrated in FIG. 4. The output signals from the various sensor arrays 32, 36, 38 and 40 are provided to the signal conditioning and power regulation circuit 42 where the signals are assigned appropriate voltage levels and otherwise modified for acceptance by subsequent circuitry.

When the normally open g-switch 58 is closed, upon the attainment of a certain acceleration level when the projectile is fired and in the gun bore, the in-bore data recorder 44 is caused to commence recording. Recording of in-bore data at a high speed first rate, for example 150 ksamples/sec, continues for a predetermined period of time (measured in milliseconds) . After the projectile 10 has cleared the gun bore 12 (FIG. 1) all of the stored data in recorder 44 is read out at a second rate, for example 15 ksamples/sec, which is less than the record rate. This allows the in-bore data to be encoded, along with the in-flight data in PCM encoder 54, and be transmitted by transmitter 46, which has a limited bandwidth.

The encoded and transmitted in-bore, as well as in-flight data, is received by a ground station 70 where the data may be recorded and subsequently analyzed by known software programs for perfecting projectile design. Alternatively, the data may be used to correct any gun parameters, such as azimuth and elevation angles, for a subsequent launch.

Figure 5:
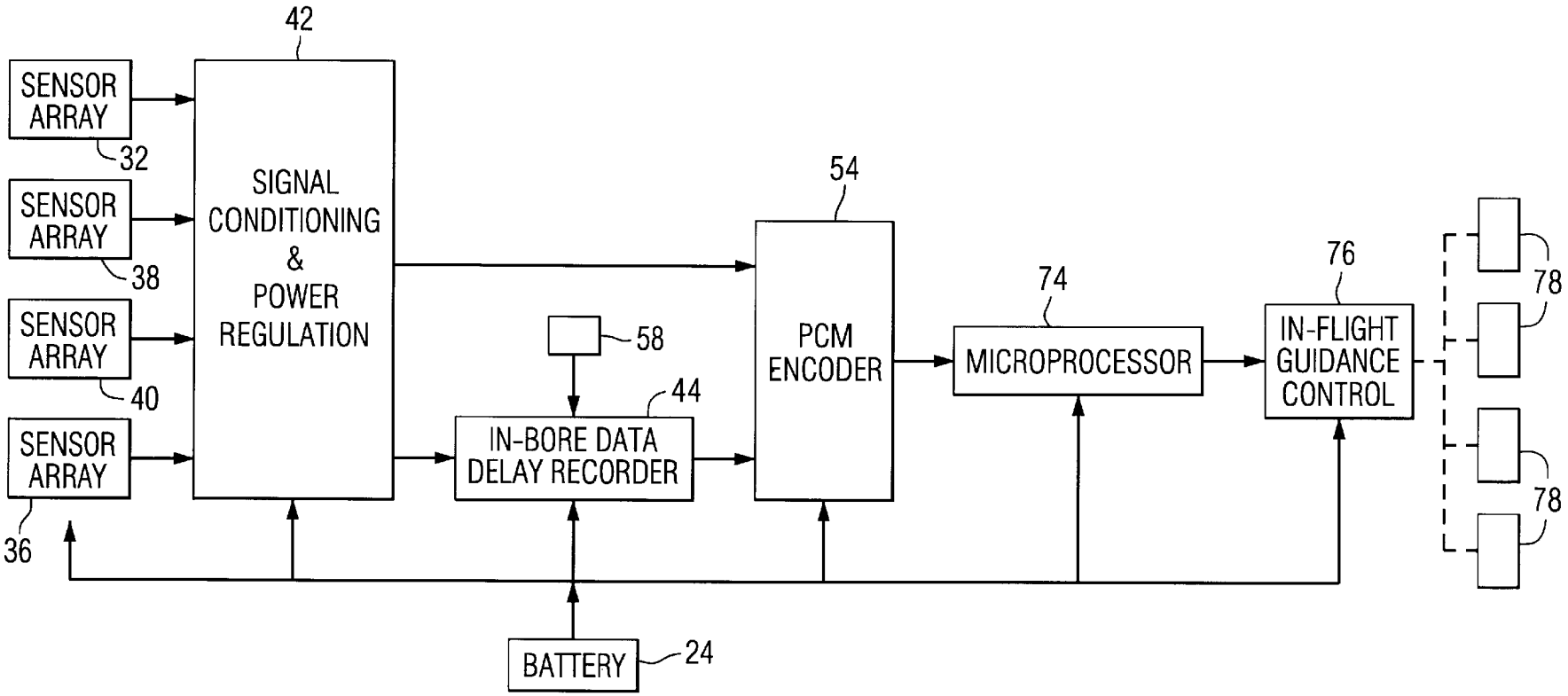
FIG. 5 is a block diagram of the diagnostic system of the present invention in a control configuration.

In addition to, or as an alternative, the diagnostic system of the present invention may be used such as illustrated in FIG. 5, which duplicates the elements of FIG. 4, except for the transmitter arrangement. More particularly, the arrangement of FIG. 5 is utilized for real-time flight control of the projectile, which would have a plurality of controllable surfaces.

In the embodiment of FIG. 5, the encoded data is provided to an on-board microprocessor 74 which analyzes the data and provides control signals to the in-flight guidance control circuit 76. The guidance control circuit 76 is coupled to a plurality of flight control surfaces, such as moveable fins 78, to modify the trajectory of the projectile, if necessary. Although not illustrated in FIG. 5, the apparatus may also include a GPS receiver for inputting navigational information to the microprocessor 74.

Figure 6:
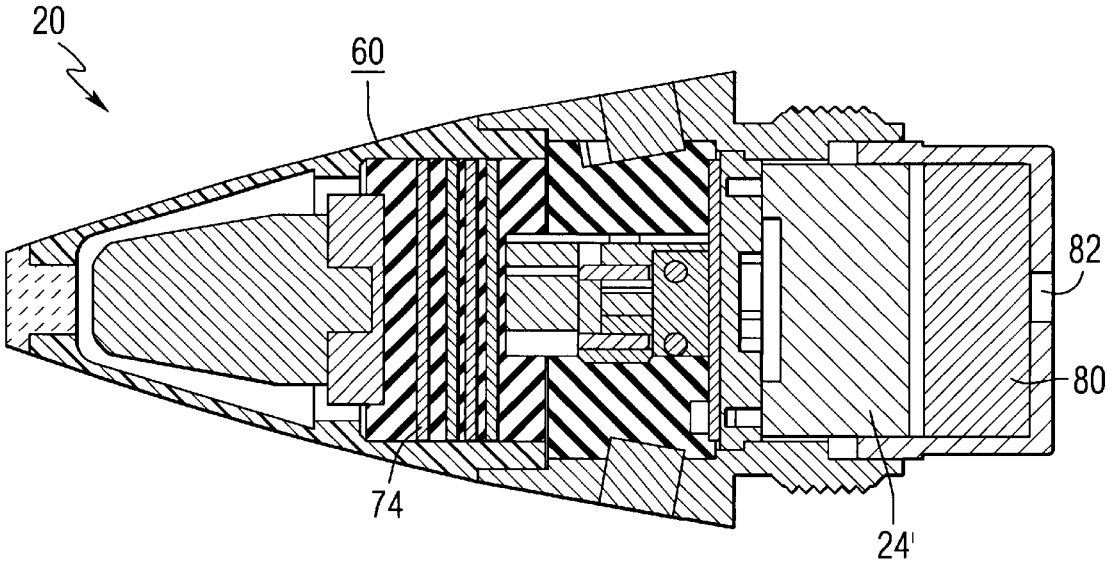
FIG. 6 is a view, as in FIG. 2, showing an additional function of the apparatus.

FIG. 6 essentially duplicates the cross-sectional view of FIG. 2, however, with a reduced size battery indicated by numeral 24', within the battery cup 22. The remainder of the battery cup 22 is occupied by a detonator device 80 operable to set off the main charge of the projectile to which the fuze-like container 60 is attached, via aperture 82 in the end of battery case 22.

Figure 7:
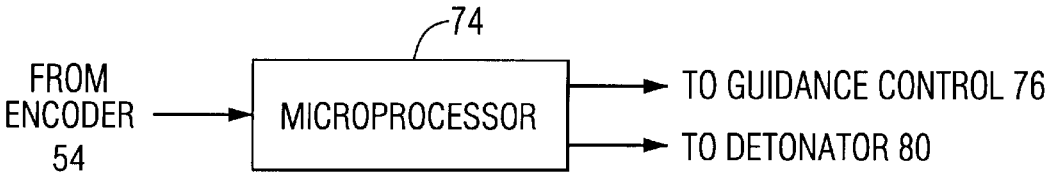
FIG. 7 is a block diagram illustrating the microprocessor of FIG. 5 and two of its outputs.

The detonator device 80 may be activated by impact with a target. Alternatively, and as indicated in FIG. 7, activation of the detonator may be accomplished by the on board microprocessor 74, if provided, as in the embodiment of FIG. 5.

Figure 11:
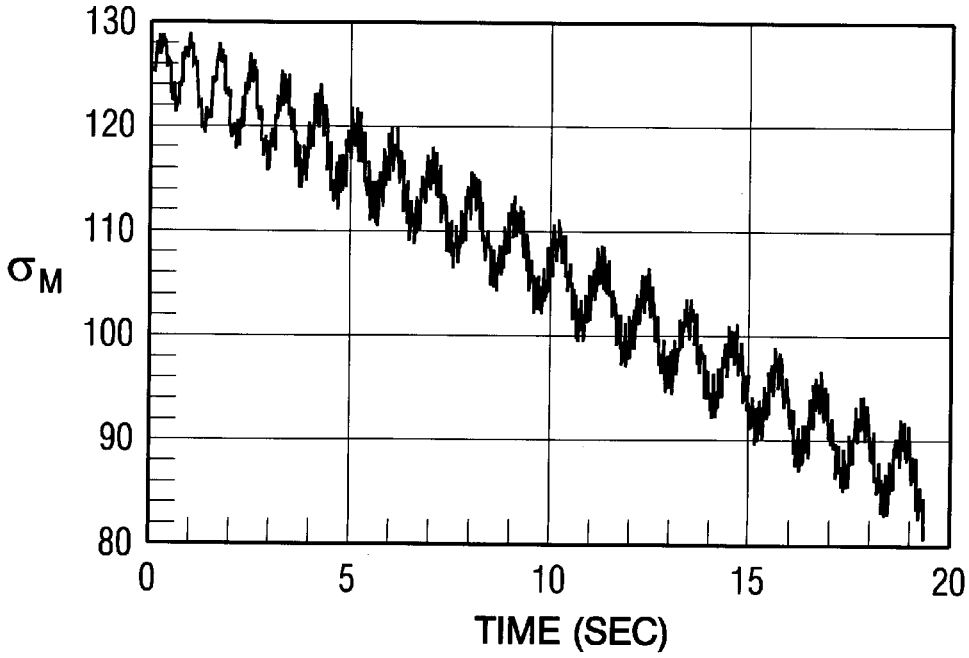
Figure 12:
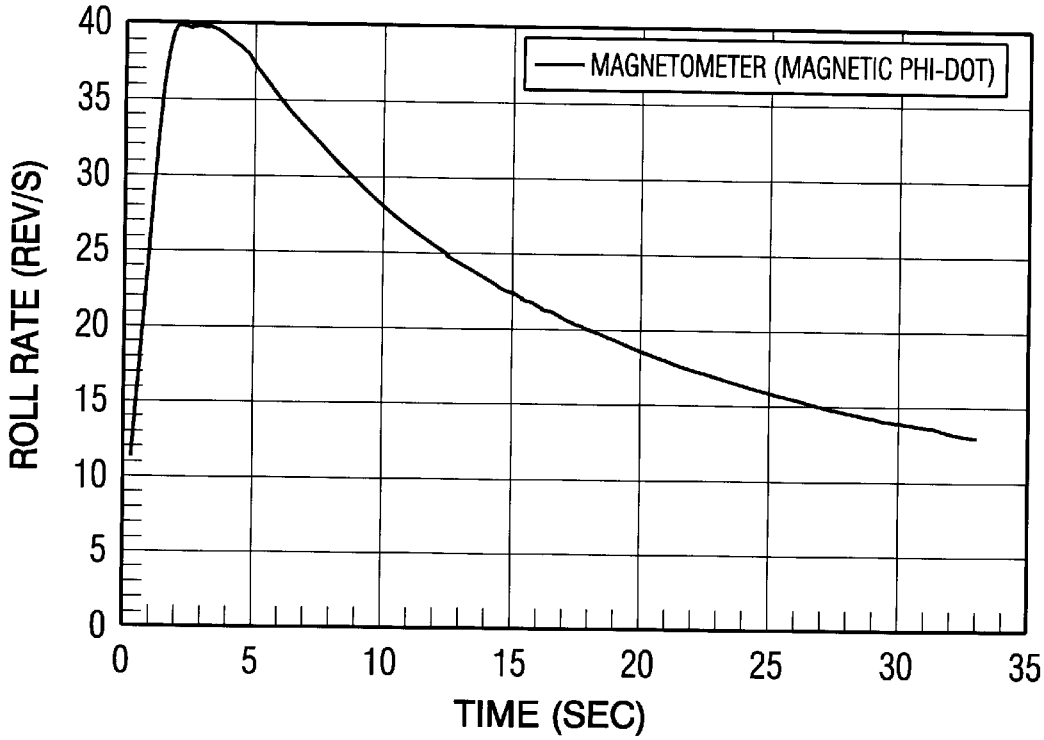
Figure 13:
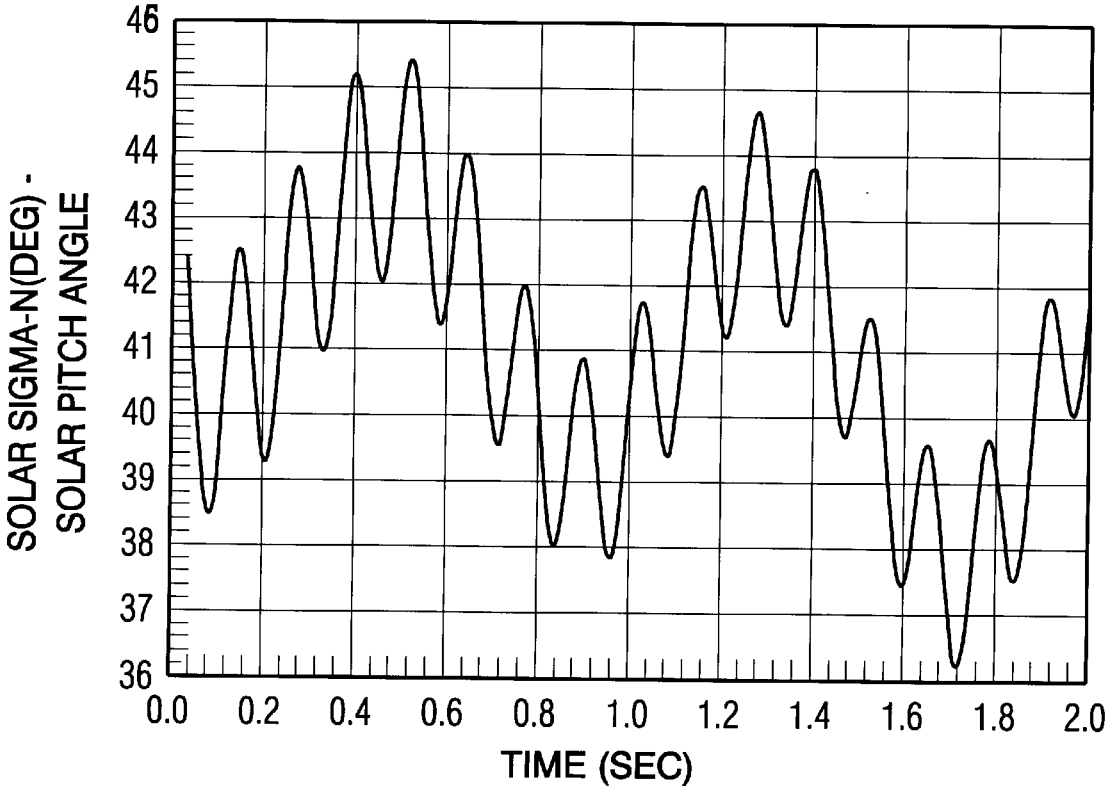
Figure 14:
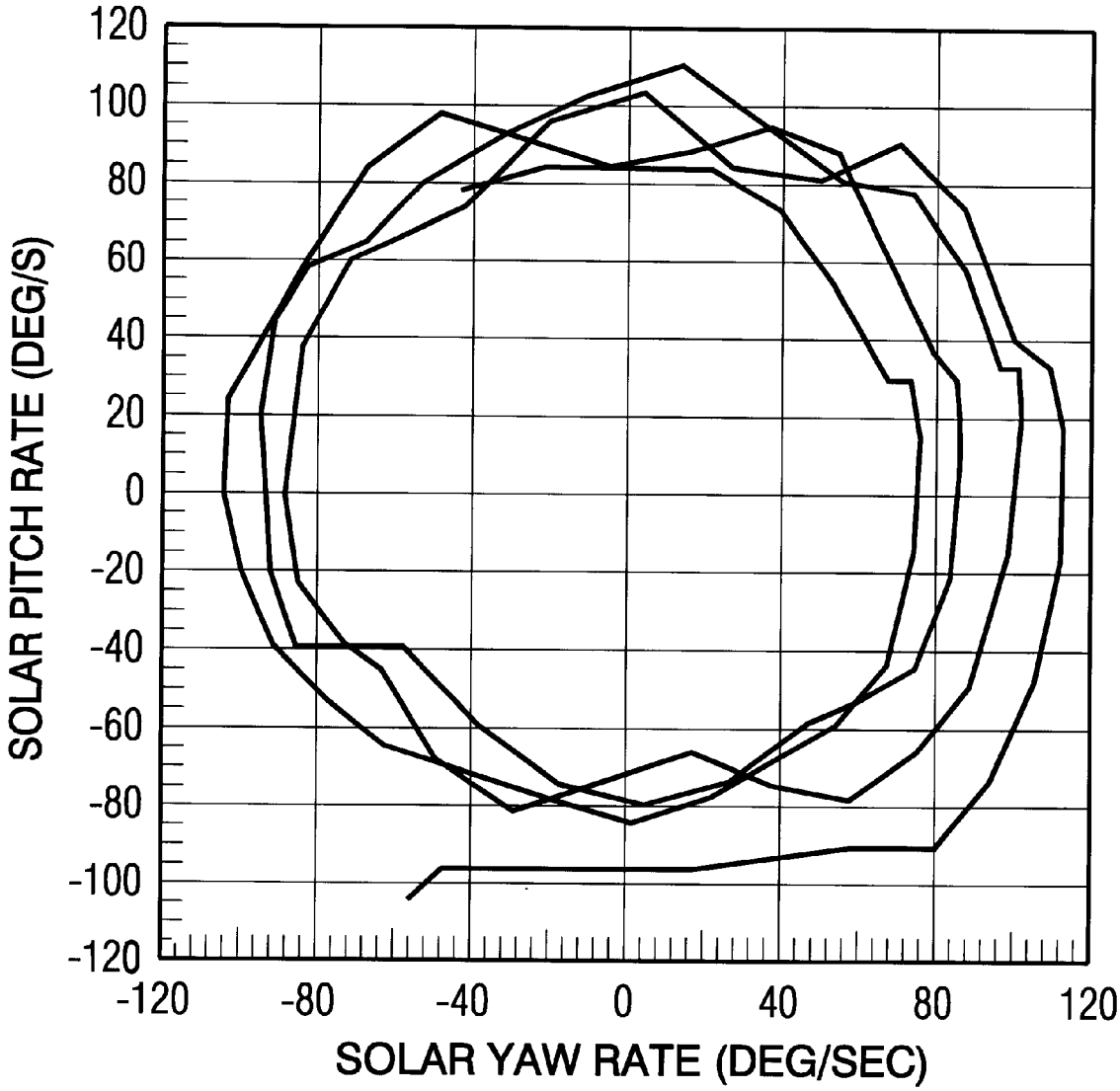

FIGS. 8 to 12, by way of example, illustrate measured data that has been recorded and processed, as a function of time, from an actual flight test of a 120 mm M831 tank training projectile and FIGS. 13 and 14 show optical sensor data from an actual flight test of a 155 mm artillery projectile.

Figure 8:
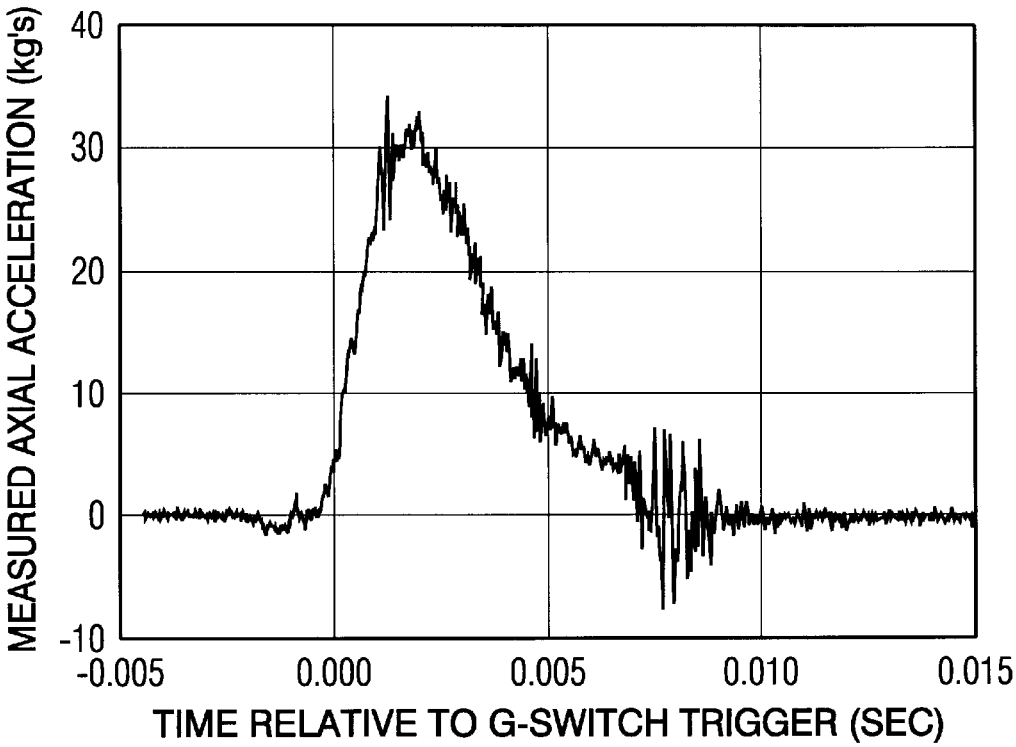
FIGS. 8 to 14 are plots of actual data acquired during a test of the present invention.

In FIG. 8, illustrating measured in-bore axial acceleration, time 0.0 is represented when the g-switch 58 closes and the set-back acceleration reaches a maximum approximately 2 ms later and thereafter tapers off until about 7 ms when it exits the gun and experiences set-forward acceleration.

Figure 9:
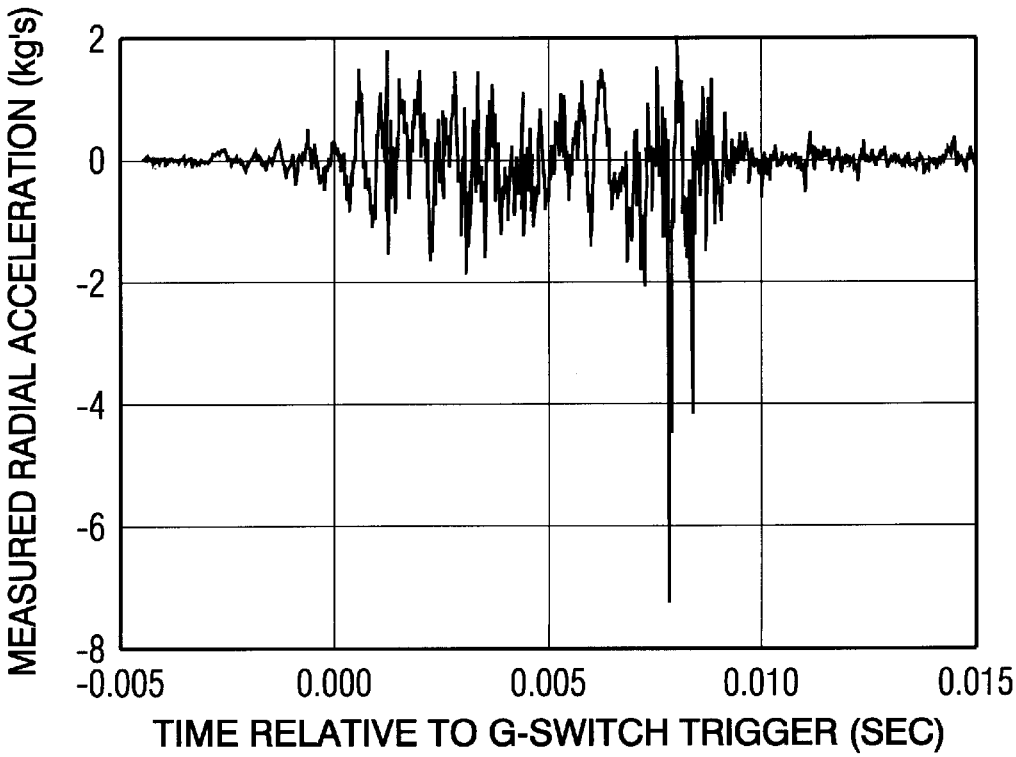

In FIG. 9, illustrating measured in-bore radial acceleration, time 0.0 is represented when the g-switch 58 closes and the projectile is balloting as it travels down the bore until it exits the gun at about 7 ms.

Figure 10:
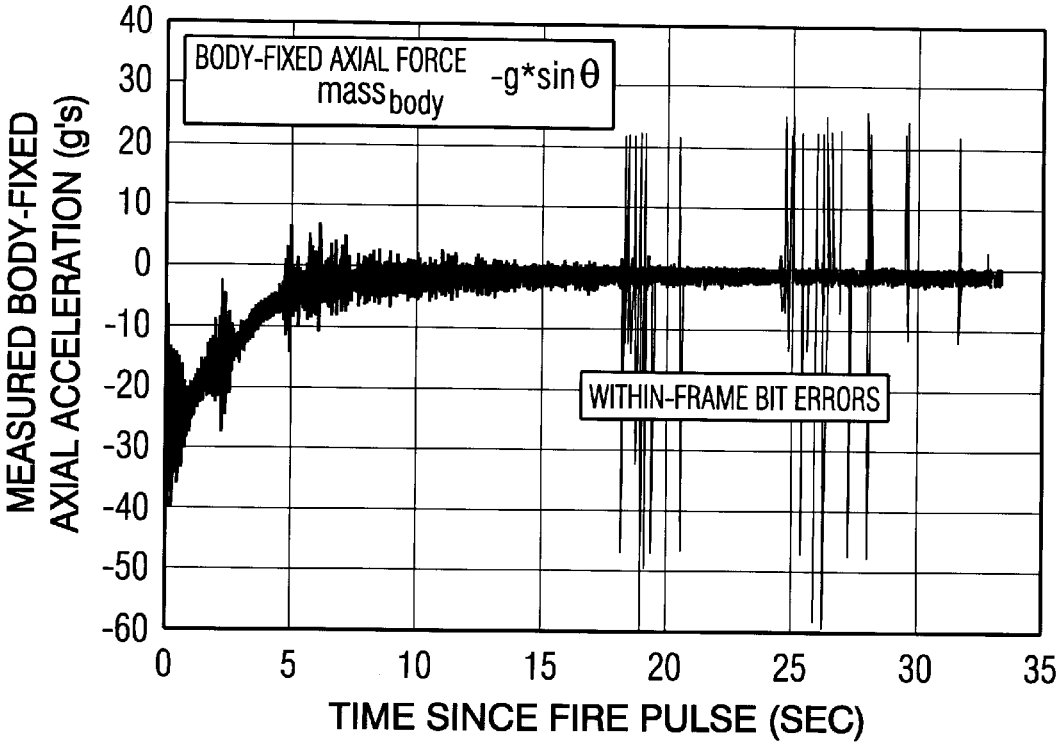

In FIG. 10, illustrating the measured in-flight axial acceleration, time 0.0 is represented from when the fire pulse to initiate the propelling charge was activated. The acceleration is negative because it is experiencing drag forces. Large vibrations from unsteady rolling behavior peaking at about 2 s and a Mach number transition at about 5 s can be observed in the frequency content of the data.

In FIG. 11, magnetometer sensor data has been reduced to obtain the projectile's pitch angle relative to the Earth's magnetic field, Sigma-M.

In FIG. 12, the magnetometer data has been reduced to obtain the projectile roll rate relative to the Earth's magnetic field.

In FIG. 13, the optical sensor data has been reduced to obtain the projectile's roll rate relative to the sun's solar vector.

In FIG. 14, the optical sensor data has been reduced to solar pitch rate as a function of solar yaw rate for the entire trajectory.

It will be readily seen by one of ordinary skill in the art that the present invention fulfills all of the objects set forth herein. After reading the foregoing specification, one of ordinary skill in the art will be able to effect various changes, substitutions of equivalents and various other aspects of the present invention as broadly disclosed herein. It is therefore intended that the protection granted hereon be limited only by the definition contained in the appended claims and equivalents. Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. An aeroballistic diagnostic system for obtaining information relative to flight of a projectile launched from the bore of a gun, comprising:

a container adapted to be attached to said projectile;

a plurality of sensor arrays positioned within said container;

at least one of said arrays being operable to obtain projectile data during in-bore travel of said projectile;

remaining ones of said arrays being operable to obtain projectile data during in-flight travel of said projectile;

recording means carried by said container and operable to sample and store said in-bore data and to output said stored data after said projectile exits said gun;

utilization means for receiving encoded data; and encoding means operable to encode said in-bore data which is output from said recording means, as well as to encode said data provided by said remaining ones of said arrays, and to provide the encoded data to said utilization means.

2. A system according to claim 1 wherein:

said container is aerodynamically shaped and is positionable on the front end of said projectile.

3. A system according to claim 2 wherein:

said container is a fuze body having an interior into which said sensor arrays, said recording means and said encoding means are packaged.

4. A system according to claim 3 which includes:

a potting material within said interior.

5. A system according to claim 3 wherein:

said utilization means includes a transmitter and transmitter antenna for transmitting said data to a remote location.

6. A system according to claim 5 wherein:

said transmitter and transmitter antenna are also packaged within said interior of said fuze body.

7. A system according to claim 3 wherein:

said fuze body has a threaded portion which threads into the front of said projectile and replaces the conventional fuze of said projectile.

8. A system according to claim 3 wherein:

said recording means records at a first rate and outputs, repetitively, at a second rate which is slower than said first rate.

9. A system according to claim 8 wherein:

said output rate is 1/10 said input rate.

10. A system according to claim 1 which includes:

a normally open g-switch;

said g-switch being operable to start said recording means when said g-switch closes, due to a predetermined acceleration.

11. A system according to claim 1 wherein:

one of said arrays obtains data relative to in-bore axial acceleration of said projectile; and another of said arrays obtains data relative to in-flight axial acceleration of said projectile.

12. A system according to claim 11 wherein:

said projectile additionally rotates during launch and in-flight; and wherein another of said arrays obtains data relative to in-bore radial acceleration of said projectile; and yet another of said arrays obtains data relative to in-flight radial acceleration of said projectile.

13. A system according to claim 11 wherein:

said projectile includes a plurality of moveable control surfaces for controlling directional flight of said projectile;

said utilization means includes an in-flight guidance control circuit for governing operation of said control surfaces; and wherein said utilization means additionally includes a microprocessor responsive to data provided by said encoding means to regulate said in-flight guidance control circuit.

14. A system according to claim 11 wherein:

said projectile carries a main explosive charge; and which includes a detonator positioned within said container at a location to cause ignition of said main explosive charge under predetermined conditions.

15. A system according to claim 6 wherein:

said fuze body includes a nose portion;

said transmitter and transmitter antenna being packaged within said nose portion.

16. A system according to claim 15 wherein:

said nose portion is of a non-metallic material.

17. A system according to claim 16 wherein:

said nose portion includes a nose tip;

said nose tip being of a ceramic material.

* * * * *